United States Patent [19]

Harris

[11] 4,095,066

[45] June 13, 1978

[54] HINGED FLYPLATE ACTUATOR

[75] Inventor: Richard Hunter Harris, Raleigh, N.C.

[73] Assignee: International Business Machines Corporation, Armonk, N.Y.

[21] Appl. No.: 711,658

[22] Filed: Aug. 4, 1976

[51] Int. Cl.[2] ..... H01H 5/30

[52] U.S. Cl. ..... 200/67 A; 200/68; 200/159 R

[58] Field of Search ..... 200/67 A, 67 PK, 339, 200/68, 159 R; 340/365 C

[56] References Cited

U.S. PATENT DOCUMENTS

| | | | |
|---|---|---|---|
| 2,769,051 | 10/1956 | Taylor | 200/67 A |
| 3,548,138 | 12/1970 | Van Dine | 200/159 |
| 3,653,038 | 3/1972 | Webb et al. | 340/365 C |
| 3,671,822 | 6/1972 | Leno | 200/159 |
| 3,693,059 | 9/1972 | Harris | 200/159 |
| 3,696,908 | 10/1972 | Gluck et al. | 340/365 C |
| 3,899,648 | 8/1975 | Murata | 200/5 A |
| 3,916,135 | 7/1974 | Holden et al. | 200/339 |
| 3,941,953 | 3/1976 | Mission et al. | 200/5 A |
| 3,962,556 | 6/1976 | Kravchuck | 200/159 R |

FOREIGN PATENT DOCUMENTS

| | | | |
|---|---|---|---|
| 2,229,406 | 1/1973 | Germany | 340/365 C |
| 169,676 | 12/1959 | Sweden | 200/68 |

*Primary Examiner*—Samuel W. Engle
*Assistant Examiner*—Ralph Palo
*Attorney, Agent, or Firm*—E. H. Duffield

[57] ABSTRACT

A toggling type of switch actuator is described in which a pivotable coupling plate is caused to snap away from electrical contact members which it couples together. Action is caused by the depression of an actuator which compresses a spring and moves the line of action of compressive force over center to cause a snap-action motion. Pushbutton actuation is achieved in a very low profile apparatus providing good tactile feel and a self-biased, self-returning, snap-action. The device has only three moving parts.

8 Claims, 8 Drawing Figures

FIG. 2
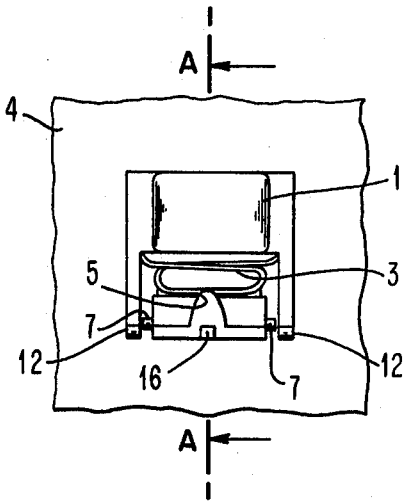
FIG. 3
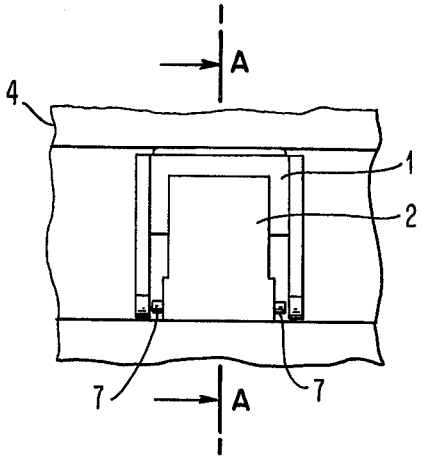
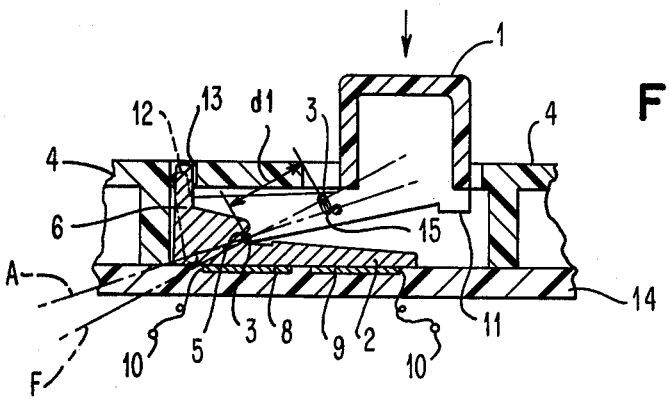
FIG. 4A
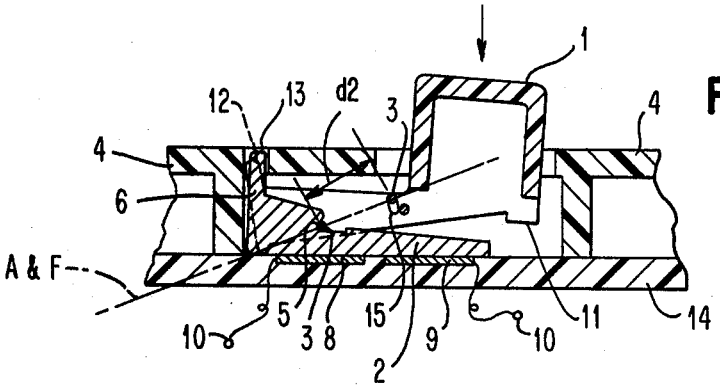
FIG. 4B

HINGED FLYPLATE ACTUATOR

FIELD OF THE INVENTION

This invention relates to push-button switch actuators and toggling mechanisms in general and in particular to fly-away or snap-action devices for switch actuators which utilize a pivoting motion.

PRIOR ART

A wide variety of toggle switch mechanisms exists in the prior art. In general, a push-button actuator is normally provided having means for allowing vertical motion of the push button. Motion of the push button is normally transferred to a compression spring and means are provided for biasing the spring to snap or bow outward in one direction or another. This is often achieved in response to a twisting moment and compression or to a lateral deflection of one end of the spring relative to its other end. This causes the spring to buckle from one bowed outward configuration to the opposite configuration and produces a sudden snap action at its opposite end which is transferred to a moving contact or coupling element. In such devices, however, some means is usually provided for not only compressing a spring but for laterally displacing one end of it relative to its own center line in order to impart an opposite reactive action at its opposite end. In straight line push-button motion devices, however, it is usually the case that some auxiliary deflection means must be provided since the key button actuator itself does not impart the necessary torsional or bending moment to cause the snap action. An exception to this is my own prior U.S. Pat. No. 3,699,296 which shows a toggling type of push-button actuator using straight linear motion of the actuator. However, this patent does not provide a means for applying the snap action to a coupling or fly-away contact plate but utilizes the snapping spring member itself as a contact.

Another prior art patent is U.S. Pat. No. 3,671,822 in which a pivoting coupling plate or contacting plate is caused to snap away from capacitive plates by the linear motion applied to compression springs by a linearly moving push-button actuator. However, in this patent, sudden snap action detenting means are necessary in order to provide the desired tactile feel and sudden snap action. The additional mechanism involved in the cited instance requires magnetic detents which add to the expense and complexity of the device. Also, due to the elongated nature of the compression springs utilized in this patent, the vertical profile of the switch mechanism is quite tall, which is contrary to the currently desired low profile switch actuators exemplified by such U.S. Pat. Nos. as 3,916,135, 3,338,226 or 3,941,953. In these patents a variety of different snap actuating domes, convex springs, or buckling spring elements are shown, however, these devices do not provide a low profile, flyaway contact make, break or coupling apparatus.

It is also well known to utilize capacitive coupling switch designs such as illustrated by my own prior patent 3,693,059 or by U.S. Pat. Nos. 3,715,747, 3,940,578, 3,797,630, 3,660,838, 3,751,612, 3,778,817, or 3,696,908. Also, other publications show a variety of capacitive switch actuators such as the IBM Technical Disclosure Bulletins Volume 17, No. 11, April 1975, page 3377 or Volume 13, No. 11, April 1971, pages 3301 and 3302.

In light of the foregoing shortcomings in the prior art in which low profile actuators do not provide for a fly plate or fly-away contact breaking action or in which devices which provide the desired action do not exibit low profile toggling type actuation or in which complicated and expensive detenting mechanisms or other cam surface or auxiliary elements are required to provide the desired action, the objects of this invention are as follows.

OBJECTS OF INVENTION

An object of this invention is to provide an improved, low profile, snap action device for operating a shunt or coupling member in a fly-away snap action mode.

A further object of this invention is to provide an improved snap actuator device for electrical switches which does not require detents or other force restraining elements to provide the snap action.

Still another object of this invention is to provide an improved toggle mechanism capable of being operated by a push-button rather than a lever or slide and in which the toggling snap action can be applied to a movable member for fly-away snap action to make or break an electrical circuit or coupling.

SUMMARY

The foregoing objects of the invention are met by providing an improved switch mechanism design in which a pivoting or rocking push-button actuator is utilized to provide a compressive force to a spring mounted between the push-button actuator and a coupling plate, or other transducer operator, which is pivotable about one of its edges. The design is such that the line of action of force of the compression spring is caused to move over the center line of the pivot point of the coupling interrupting, or connecting element, thereby causing a sudden snap action pivot or rotation of this element about its pivot point. The key mechanism is inherently self-biased in that it will return to a normally closed or open state, whichever is desired, and no additional springs or biasing or detent means are required. The compression spring element fulfills the dual purpose of biasing the key button actuator into its upward position and of causing a self-return action for the coupling member to its initial or rest condition upon the release of pressure on the key actuator.

BRIEF DESCRIPTION OF DRAWINGS

The foregoing objects of the invention are provided in a preferred embodiment thereof described and shown by the following figures of which:

FIG. 2 is the top view of the assembly shown in FIG. 1, but with the overlying cover or framework removed for clarity.

FIG. 3 illustrates a bottom view of the assembly shown in FIG. 1, but with the circuit board or contacting elements underlying the fly plate removed for the sake of clarity.

FIG. 4A illustrates a horizonal cross-section taken along Line AA illustrated in FIGS. 2 and 3 and which shows the operative elements with the switch in the unactuated or up position.

FIG. 4B illustrates the mechanism as illustrated in FIG. 4A, but with the actuator partially depressed to the critical or incipient snap position.

DETAILED SPECIFICATION

Figure 1:
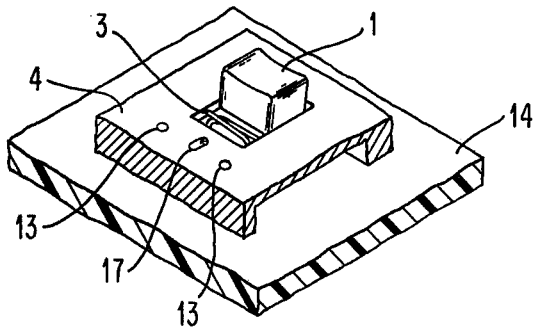
FIG. 1 is an oblique, partially cutaway, pictorial view illustrating the elements of the apparatus as assembled.

Turning now to FIG. 1, an oblique pictorial view of a broken away portion, an assembly of the preferred embodiment of the invention is shown. Only a single given key button actuator position in a matrix keyboard having numerous such keys, is illustrated. In FIG. 1, the key button actuator 1 is shown in the up or unactuated position. Key button 1 is of molded plastic or similar material and comprises a key cap portion mounted on a lever arm which is molded integrally therewith and which has, on the opposite end of the lever arm, the small projection 12 which acts as a locating and pivot pin in aperture 13 in the top cover of framework 4. A compression spring 3 is contained at one end in a slot 15 in the key button actuator 1 and at its other end in a slot 5 located in a portion of the fly-away plate or contacting plate 2.

Figure 1A:
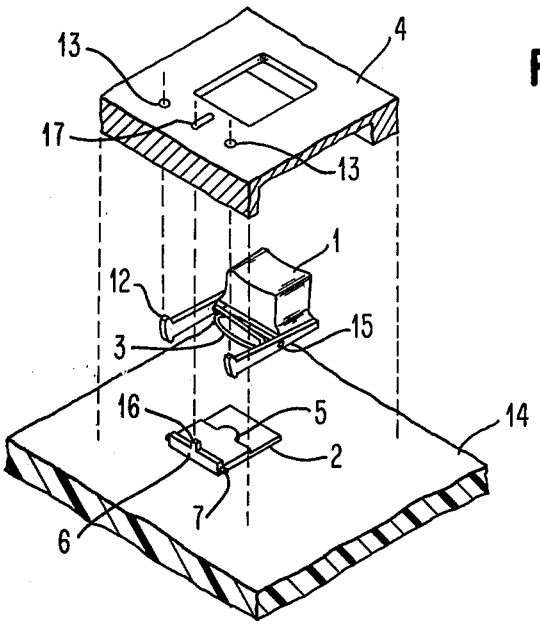
FIG. 1A is an oblique exploded view of the assembly in FIG. 1.

The foregoing elements may all be seen to better advantage in FIG. 1A which shows an exploded view of the assembly shown in FIG. 1. A movable actuating plate 2 is generally L-shaped and has a foot or vertical projection 6 as shown. The actuating plate, when used for a capacitive coupling embodiment as shown, is called fly plate 2 and is designed to lie between two arms of the lever portion of key button 1 and to be maintained there by small projections 7 which slidingly abutt the interior surfaces of the lever portions of key button 1 as shown.

The fly plate or connecting plate 2 would ordinarily be made of conductive material, such as metal, or of a molded conductive plastic material, as is preferred for electrical capacitance or conductance embodiments. Thus constructed, the coupling or fly plate 2 can capacitively and/or electrically couple conductors 8 and 9 embedded in the surface 14 of an insulative circuit board or support as shown later in FIGS. 4A–4C. Output connections 10 are provided to electrically connect the conductor plates or contacts 8 and 9 to any using exterior device which it is desired to control by means of a key switch actuation. It should be clearly understood that, while a capacitive coupling or, alternatively, an electrical shorting mode of operation is illustrated for the preferred embodiment, the movable actuating plate 2 could obviously be adapted for other embodiments such as Hall effect sensors or light beam interrupting devices as would be clearly evident to one of skill in the art. Such types of transducers are well known and the moving plate 2 could clearly be used to actuate such transducers instead of electrically coupling the conductive plates 8 and 9.

In FIG. 2, a top view of the assembly shown in FIG. 1 is illustrated. The framework and covers 4 have been cut away in the view in FIG. 2 in order to show the relationship between the key button actuator 1 and the fly plate 2. The two separate lever arms which are integrally molded into key button 1, each of which lever arms has a small locating projecting 12 which engages an aperture 13 in cover 4. These arms are clearly seen to overlap the width of the fly plate 2 so that fly plate 2 is enclosed between the inner surfaces of each of the lever arm portions of key button 1, thus centering the fly plate 2 and holding it in position. In order to reduce sliding friction between the sides of the lever arms in key button 1 and the sides of the fly plate 2, small raised projections 7 are formed at the edges of fly plate 2 as shown to provide a small clearance between the surfaces except for contact with the small area on the end of projections 7. Of course, the projections could be placed on the inner surfaces of the lever arms of key button 1 instead.

In FIG. 3, a bottom view of the assembly shown in FIGS. 1 and 2, the relationship between the fly plate 2 and the lever arms formed with key button 1 is even more clearly depicted and it may be seen that the small projections 7 molded integrally with fly plate 2 hold it centered between the lever arms formed on key button 1.

In FIG. 4A, a cutaway portion of a section taken along Line AA in FIGS. 2 and 3 is illustrated. In FIG. 4A, key button 1 is in the unactuated or undepressed state. The compression spring 3 is shown extended to a dimension $d_1$ between the locating notches 15 and 5, respectively in key button 1 and in fly plate 2, respectively. Spring 3 is initially compressed to provide an initial key force or key load which restores key button 1 to the upward position and tends to bias it there. It may be seen that key button 1, thus biased upwards against frame 4, will have small projections 12 on the ends of the lever arms of key button 1 located and held in the apertures 13 in the top cover 4 of the frame. The main body of key button 1 passes up through an aperture in the top cover as illustrated and the clearance in the various apertures through which the projections 12 pass or the main body of key button 1 passes are sufficient so that key button 1 may be freely depressed once the restoring force of spring 3 has been overcome. Fly plate 2 is located in its operative position with projection 16 extending through aperture 17 as shown in FIGS. 1 and 1A.

Also shown in FIG. 4A are the contacts or capacitive conductor plates 8 and 9 together with the signal leads 10 which connect them to a using circuit. The contacts or capacitive plates are located upon or embedded in the surface 14 of a circuit board or other suitable dielectric material.

A projection 11 is formed on the underside of key button 1 to limit the downward degree of travel that may be experienced when key button 1 is depressed since projection 11 will contact the surface 14 of the circuit board.

The center line of spring 3 in FIG. 4A is depicted as Line F and it forms some acute angle with the horizontal surface of the circuit board, surface 14. Center Line F of spring 3 is the line of force through which spring 3 acts. It may be seen that Line F falls below the corner of fly plate 2 in the vicinity of projections 7. Therefore, there is a normal force, or a component of normal force, applied to fly plate 2, tending to bias it in a downward position in contact with or in coupling relationship with conductors 8 and 9. Another line is illustrated as Line A and passes through the corner about which the L-shaped fly plate 2 can pivot and through the center of notch 5 in which spring 3 is located. Line A represents the line of stability for fly plate 2, and it should be apparent that if some means is provided for changing the line of force F to pass above Line A, there will be a net component of force in the horizontal direction (to the left in FIG. 4A) which will tend to cause fly plate 2 to pivot about its corner until the vertical portion 6 of fly plate 2 contacts the wall of the frame 4.

In FIG. 4B, key button 1 is shown partially depressed so that the projections 12 in apertures 13 have allowed a slight degree of pivoting in key button. The resulting action has compressed spring 3 to a new dimension $d_2$ which is slightly less than the previous dimension $d_1$ depicted when key button 1 is in the up position in FIG. 4A. It will be noted in FIG. 4B that the line of force, Line F, has moved to be in coincidence with the line of stability, Line A, but that the small projection 11 on the bottom of key button 1 is still not in contact with surface 14 of the circuit board. In the position illustrated in FIG. 4B, snap over or instability of fly plate 2 is incipient, but contact of fly plate 2 between the conductors 8 and 9 is still maintained.

Figure 4C:
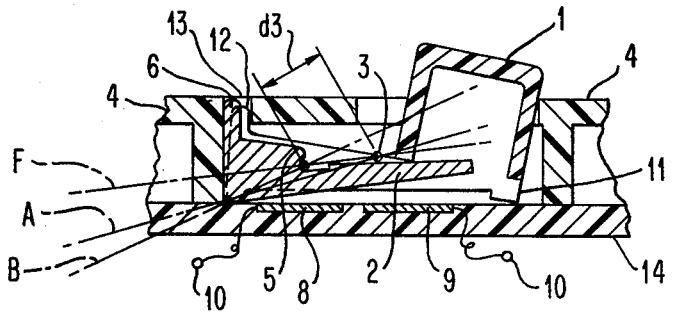
FIG. 4C illustrates the mechanism illustrated in FIGS. 4A and B but with the actuator depressed beyond the critical position to its actuated or snap motion producing position, with the actuator itself bottomed out at a fully depressed position.

In FIG. 4C, the situation is illustrated just after an additional amount of depression has been applied to key button 1. This will cause a sudden snap over of the fly plate 2 until its vertical projection 6 is in contact with the wall of frame 4. This action occurs rapidly in a snapping mode with fly plate 2 pivoting about its corner into the upward position as illustrated in FIG. 4C where it no longer contacts conductors 8 and 9 in the surface 14 of the circuit board on which the key switch is located by frame 4. Spring 3 assumes a new length $d_3$ which is slightly greater than the dimension $d_2$. This means that spring 3 has expanded slightly between the position shown in FIG. 4B and that shown in FIG. 4C. This release of force by spring 3 and new line F of force cause a reduction in key force and sudden snap action which provides a desirable tactileaudible, feedback to the operator. It may be seen in FIG. 4C that the new line of force F now passes well above the corner pivot of fly plate 2, well above Line A which was the old line of stability, and that there is no net downward or normal force on fly plate 2 tending to hold it in the downward position. It will also be noticed that the projection 11 on key button 1 is now in contact with the surface 14 of the circuit board, thus limiting any further depression of key button 1. The snap action occurs before projection 11 contacts surface 14, however, so that some additional travel, known as "overtravel" can occur in depressing the key button 1 after snapping has occurred.

Another line of force, Line B, is shown in FIG. 4C. Line B is drawn at the angle through which the line of force, Line F, must pass before the net horizontal force holding fly plate 2 in its pivoted position will be decreased far enough to allow a net downward force to be exerted with a reverse snapping action being created. It will be noted that the locating notch 5 in a portion of fly plate 2 is elevated from its original position slightly as shown in FIG. 4C because of the counterclockwise rotation of the fly plate 2 which has been achieved. This means that the angle of Line B is greater than the angle of Line A relative to surface 14 of the circuit board. Therefore, the line of force, Line F, must pass below Line A and, in fact, below Line B before there will be a net downward force exerted on fly plate 2 causing it to snap back into its downward position illustrated in FIG. 4A. The slight angular difference between the angle made by Line A and that made by Line B causes a physical hysteresis to occur which guarantees that, once the switch actuator has snapped over into the actuated position, force must be released beyond that required to originally make the snap action occur before the reverse snap action will occur. This is a very desirable characteristic in key switches as is well known.

It will be appreciated from FIGS. 4A through 4C that the mechanism has a very low vertical profile compared with the vertical compression spring or similar vertical stroke key button toggle mechanism. This is brought about in the design partially because of the leverage exerted by the lever arms molded with key button 1 as they pivot about their projections 12 in apertures 13. This makes possible the exertion of greater force on spring 3 and the use of a higher compression, shorter deflection spring elements than is normally utilized in vertical push key buttons of the usual sort encountered. The use of a higher force spring allows, through the leverage principle, for a suitable degree of travel in key button 1 during depression of the key button without an undue force being required to depress the key button. Also, since the physical spring 3 utilized can be made much smaller in this design, the overall key actuator can be greatly reduced in size insofar as the vertical profile is concerned. The force amplification provided by the leverage principle in key button 1 makes possible the use of a stiffer spring 3 than normally would be utilized and this provides for a rapid and clean snap action since the forces exerted, once the appropriate line of action has been passed, are sufficient to cause rapid acceleration of fly plate 2 to occur. This is a desirable feature since, once the snap over point is reached, it becomes physically impossible for a human operator to retract a finger fast enough to defeat the operation of the mechanism. This leads to a desirable feature of non teaseability so that, once key force produced by depression of key button 1 has reached a sufficient level, switch actuation will occur in a positive manner giving the desired sudden snap action and desired tactile feel feedback to the human operator.

Figure 5:
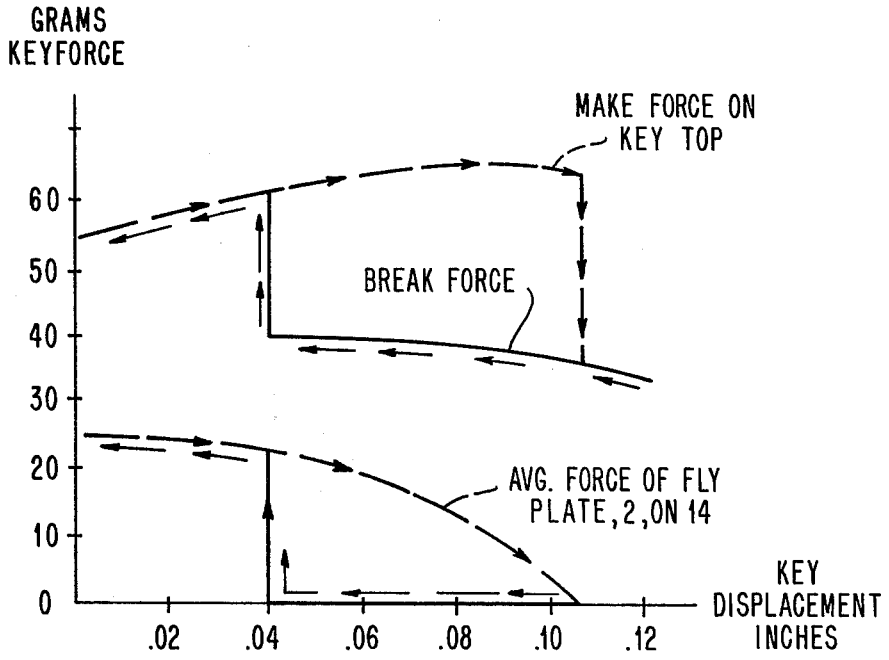
FIG. 5 illustrates a force and deflection chart for a preferred embodiment of the invention as illustrated in the foregoing FIGS. 1 through 4C in which the key force or force applied to the actuator button and the force resulting on the fly plate are separately plotted on the ordinate with the deflection of the key button plotted on the abscissa.

All of these conditions relating force on the key button 1 with distance are depicted in the graph in FIG. 5 where the key force on key button 1, and also the resulting force between fly plate 2 and surface 14, are shown in the vertical direction measured in grams is plotted as a function of key travel in the key button 1 in inches. The initial amount of compression in spring 3 has been set so that approximately 50 to 60 grams of force are required before key button 1 will begin to move. This force increases along the line beginning at the ordinate in FIG. 5 and progressing toward the right as shown by the arrows in FIG. 5. The force increases as illustrated to approximately 64 to 65 grams when the snap over point is reached and the key force drops instantaneously to a lower level of approximately 40 to 45 grams. Continued depression of key button 1 may require greater or less force, depending upon the specific angular orientation of and the physical structure of spring 3 as it is compressed between its locating notches 15 and 5, respectively. In FIG. 5, the action is depicted such that additional key force grows less and less which means that the operator's finger will continue to apply force but the force required to depress the key button will grow less and less until key button 1 actually is physically stopped by the collision between the projection 11 and the surface 14 of the circuit board. At this point, the key force would rise vertically until a physical break-down occurred without any further deflection of significant note occurring. Upon release of force, the path followed is shown by the arrows leading back toward the left in FIG. 5. The actual level of force increases slightly until the reverse snap force level is reached at which the key force increases instantaneously and the fly plate snaps back down into its contacting or coupling position.

Also depicted in FIG. 5 is the net force in the downward direction exerted by spring 3 against the fly plate 2. As may be appreciated, as key button 1 is depressed and a line of force action F rotates, the net downward force decreases gradually until it reaches zero. Since a counterclockwise moment is unopposed, fly plate 2 abruptly snaps. Upon release of key button 1, the force on fly plate 2 travels back along the abscissa to the left until the reverse snap location is reached at which the force instantaneously jumps back up to the net force line experienced during depression of the key button. This is shown in FIG. 5 by the small arrows along the dotted line of travel.

In the preferred embodiment shown, the total difference in length for spring 3 between its most relaxed position as shown in FIG. 4A to its most compressed position at the snap over point is a difference of approximately 0.018 inches and the change in spring force exerted is approximately 70 grams, although, due to the leverage principle, only approximately 10 grams of additional key force are required to exert the 70 grams longitudinally along spring 3.

It should be realized from the foregoing description that all of the elements for each key switch position required to construct a multiple key-switch keyboard could be made of inexpensive injection molded plastic parts and that there are a minimum of parts to be made and assembled, each key-switch position requiring only two moving parts and a spring to be located within a suitable framework on a suitable substrate or circuit board as shown. The low profile and lightweight structure which is created, together with the physical hysteresis in force actuation and deactuation and the tactile feel provided to the operator, are all essential and important features in good key-switch operation for use in keyboard design. Similarly, the simplicity of construction is an important feature in the design illustrated since it leads to ease of manufacture and reduced manufacturing costs.

The individual switch structure shown is of the normally closed type and using electronic logic elements in a system connected to the output leads 10 of a given switch can be configured to sense the actuation of a key by the cessation of signals or absence of signals coupled through from conductive plate 8 to conductive plate 9 by the fly plate 2. As was previously alluded to, the moving plate 2 could be used to actuate other types of normally available transducers as well. For example, the moving end of plate 2 could be magnetically polarized so as to actuate a cooperatively placed magnetic sensor, such as a Hall cell placed in the position of one of conductive plates 8 or 9. Also, the moving ends of the plate 2 could be used to make or break a light beam passing to a photo sensor, as are well known in the art of optically operated transducer types of keyboards.

It is evident that an improved general purpose actuator assembly for keyboards has been set forth which can be utilized for actuating a wide variety of specific sensors or transducers; therefore, it is intended to not limit the claims to this invention to any specific choice of transducer, but to claim the actuator mechanism itself, however, employed.

What is claimed is:

1. A push-button operated, pivoting snap-action toggle switch operating apparatus, comprising:
   - a two-ended switch actuating member having a pivot axis near one end thereof;
   - a two-ended force application member having a pivot axis near one end thereof and a push-button force application means near the other end thereof;
   - a framework for holding said pivot axes of said members with said members being spaced apart from one another and supported by their said pivot axes in said framework with said pivot axis ends of said members, respectively, adjacent to one another and with said pivot axes parallel to one another;
   - a compression spring means for resiliently resisting forces applied thereto along a line of action, said spring means being fixed between and retained in compression by said force application and actuating members, whereby said spring means resiliently urges said members apart by pivoting them on their said axes in a direction causing separation between said ends of said members which are opposite the ends in which said pivot axes are located;
   - said framework having means for restraining said members from being separated in said manner by said spring means beyond an amount necessary to maintain said spring means in compression; and
   - said compression spring means being arranged so that said line of action of compression is angled with respect to said members to pass first to one side, but to be movable to the other side of, said pivot axis of said actuating member in response to pivoting of said force application member about its said pivot axis which is occasioned by forces applied to said push-button means to pivot said force application member towards said actuating member, thereby causing said line of compression to move to the other side of said pivot axis of said actuating member and create a rotational moment of said member about its said axis, thereby causing said member to pivot toward said force application member in a sudden snap action.

2. Apparatus as described in claim 1, wherein: said spring means, at the end thereof which is fixed to said actuating member, is closer to said pivot axis of said actuating member than the other end of said spring means is to the pivot axis of said force application member where it is affixed to said force application member.

3. Apparatus as described in claim 1, wherein: said switch actuating member further comprises an electrical circuit continuity bridging means located near said end opposite to which said pivot axis is located.

4. Apparatus as described in claim 1, wherein: said switch actuating member further comprises an electrical circuit impedance modifying means located near said end opposite to which said pivot axis is located.

5. Apparatus as described in claim 1, wherein: said switch actuating member further comprises a physical effect modifying means cooperating with an electrical transducer sensitive to such physical effect located near said end opposite to which said pivot axis is located.

6. Apparatus as described in claim 2, wherein: said switch actuating member further comprises an electrical circuit continuity bridging means located near said end opposite to which said pivot axis is located.

7. Apparatus as described in claim 2, wherein: said switch actuating member further comprises an electrical circuit impedance modifying means located near said end opposite to which said pivot axis is located.

8. Apparatus as described in claim 2, wherein: said switch actuating member further comprises a physical effect modifying means cooperating with an electrical transducer sensitive to such physical effect located near said end opposite to which said pivot axis is located.

* * * * *